United States Patent [19]

Hosoi et al.

[11] 4,434,693

[45] Mar. 6, 1984

[54] PLATE POSITIONING APPARATUS

[75] Inventors: Kinji Hosoi, Machida; Hiroyuki Takeda, Yokohama; Hisao Kobayashi, Yamanashi; Daijiro Konaka, Zama, all of Japan

[73] Assignee: Nihon Early Kabushiki Kaisha, Tokyo, Japan

[21] Appl. No.: 359,081

[22] Filed: Mar. 17, 1982

[30] Foreign Application Priority Data

Aug. 14, 1979 [JP] Japan ..... 54-111253

[51] Int. Cl.[3] ..... B21D 28/04; B21D 26/28; B21D 43/00

[52] U.S. Cl. ..... 83/71; 83/278; 83/410; 83/412; 83/468; 269/73

[58] Field of Search ..... 83/278, 207, 254, 71, 83/410, 412, 468; 269/73

[56] References Cited

U.S. PATENT DOCUMENTS 3,293,971 12/1966 Kuss ..... 83/412
3,716,716 2/1973 Marantette et al. ..... 83/71 X
3,738,504 6/1973 Vail et al. ..... 83/278
4,026,536 5/1977 Netto ..... 269/73
4,143,571 3/1979 Oxenham ..... 83/412

FOREIGN PATENT DOCUMENTS 55-122933 9/1980 Japan .

*Primary Examiner*—Donald R. Schran
*Attorney, Agent, or Firm*—Wenderoth, Lind & Ponack

[57] ABSTRACT

A plate positioning apparatus for use with a punch machine having a number one workpiece stopper that moves left and right along the direction of the X axis and a number two workpiece stopper that moves to and fro along the direction of the Y axis perpendicular to the X axis, each workpiece stopper having its own motor. The number one workpiece stopper moving left and right relative to the punch along the direction of the X axis structured with a corner cutout on its inner leading edge so as to allow the punch to pass through. The number two workpiece stopper moves to and fro relative to the punch along the direction of the Y axis structured with a cutout section in the middle of its leading edge so as to allow the punch to pass through, the two cutout openings meeting at the forwardmost point of intersection to allow the punch to pass through.

4 Claims, 4 Drawing Figures

PLATE POSITIONING APPARATUS

BACKGROUND OF THE INVENTION

The present invention relates to an apparatus for positioning plate materials and to be used on such multiple-hole punching machinery as press machinery for punching multiple holes in plate materials.

Conventionally, in punching multiple holes in plate materials, the operator has had to pre-mark the hole sites on the plate material and then maneuver the punch equipment punch, etc. to the site of scheduled punching.

This conventional method has suffered from the disadvantages that considerable time and energy had to be expended pre-marking the scheduled punch sites on the plate material and maneuvering the plate material and punch machinery.

Accordingly, an automatic positioning device was recently invented to determine the positions on the plate materials mechanically, this device being as shown in Japanese utility model application No. 19062/1979 (laid open No. 122933/1980).

However, because machines based upon this prior invention have had a second mount moving in the direction of the Y axis mounted on top of the first mount moving in the direction of the X axis and have had a single L-shaped workpiece stopper on this second mount extending in both the X and Y directions, they have suffered from the following disadvantages.

Because the means of motion along the X axis and the means of motion along the Y axis are structured in an overlapping format, the equipment structure is complex and the production of intricate pieces is hence very expensive. Further, because the workpiece stopper used for positioning the plate material is a single L-shaped piece, it is impossible to punch holes in locations near the piece perimeter. In effect, punching holes near the piece perimeter requires that both punch and die approach the edge of the workpiece stopper, yet in such cases the approach of the punch with reference to the workpiece stopper is limited by the outer edge of the punch base and the outer edge of the die such that it is in fact impossible to bring the punch close to the workpiece stopper. It is thus a purpose of this present invention to provide easy positioning by decreasing the number and complexity of parts through providing separate motors for moving the workpiece stopper along the X axis and for moving the workpiece stopper along the Y axis.

Another purpose of the present invention is to provide easy positioning enabling the punching of holes in locations near the perimeter of the piece through structuring a cutout section in the forward edge of the workpiece stopper which is movable along the Y axis.

A further purpose of the present invention is to provide a positioning mechanism which can be computer-controlled or numerically controlled by utilizing reversible pulse motors to drive the screw axles serving as the drive mechanisms for the workpiece stoppers which move along the X axis and along the Y axis.

SUMMARY OF THE INVENTION

The apparatus of the present invention is equipped with a number one workpiece stopper which is movable back and forth along the X axis left and right relative to the punch machine, such as a press punch machine, and a number two workpiece stopper which is movable back and forth along the Y axis to and fro relative to the punch machine.

Said number one workpiece stopper is constructed so as to be moved back and forth by the number one motor along the X axis so that its leading edge at the forwardmost position is under the punch mechanism (e.g. punch) and is structured with its leading edge and inside edge as two straight edges at right angles, with, moreover, the corner where these two straight edges intersect cutout in a reverse-corner configuration so that the punch can pass through when the number one workpiece stopper is at its forwardmost position.

The number two workpiece stopper moves along the Y axis to and fro relative to the punch with its leading edge directly under the punch at its forwardmost position, with its leading edge parallel to the X axis and extending out left and right to both sides of the punch, and with its leading edge having a cutout section in it such that the punch can pass easily through this cutout section when the number two workpiece stopper is at its forwardmost position.

The number one and number two motors are each equipped with its own screw axle turned by a reversible pulse motor and equipped with movable stands threaded to the screw axle such that the direction and amount of rotation of the screw axle determines the direction and distance of movement of the movable stand. The number one workpiece stopper is attached firmly to the movable stand moved by the number one motor and the base end of the number two workpiece stopper is attached firmly atop the movable stand moved by the number two motor, which stand is itself moved by a screw axle positioned perpendicular to the screw axle of the number one workpiece stopper at the number one screw axle's central part.

The number one workpiece stopper moves along a line parallel to the leading edge of the number two workpiece stopper so as to push the plate material along the X axis while the number two workpiece stopper moves parallel to the leading edge of the number one workpiece stopper so as to move the plate material along the Y axis.

The number one workpiece stopper and number two workpiece stopper are designed so that the leading edge of the number two workpiece stopper should touch the inner edge of the number one workpiece stopper when the number two workpiece stopper is at its forwardmost position; and so that the cutout sections of the number one workpiece stopper and the number two workpiece stopper are aligned with sufficient room for the punch to pass through when both the number one workpiece stopper and the number two workpiece stopper are at their forwardmost positions.

The number one motor and number two motor can be moved with electronic control devices such as microcomputers, the input signal for commanding the microcomputer entered with a keyboard.

BRIEF DESCRIPTION OF THE DRAWINGS

The present invention is illustrated in detail in the accompanying illustrations in which.

DETAILED DESCRIPTION OF THE PREFERRED EMBODIMENT

Figure 1:
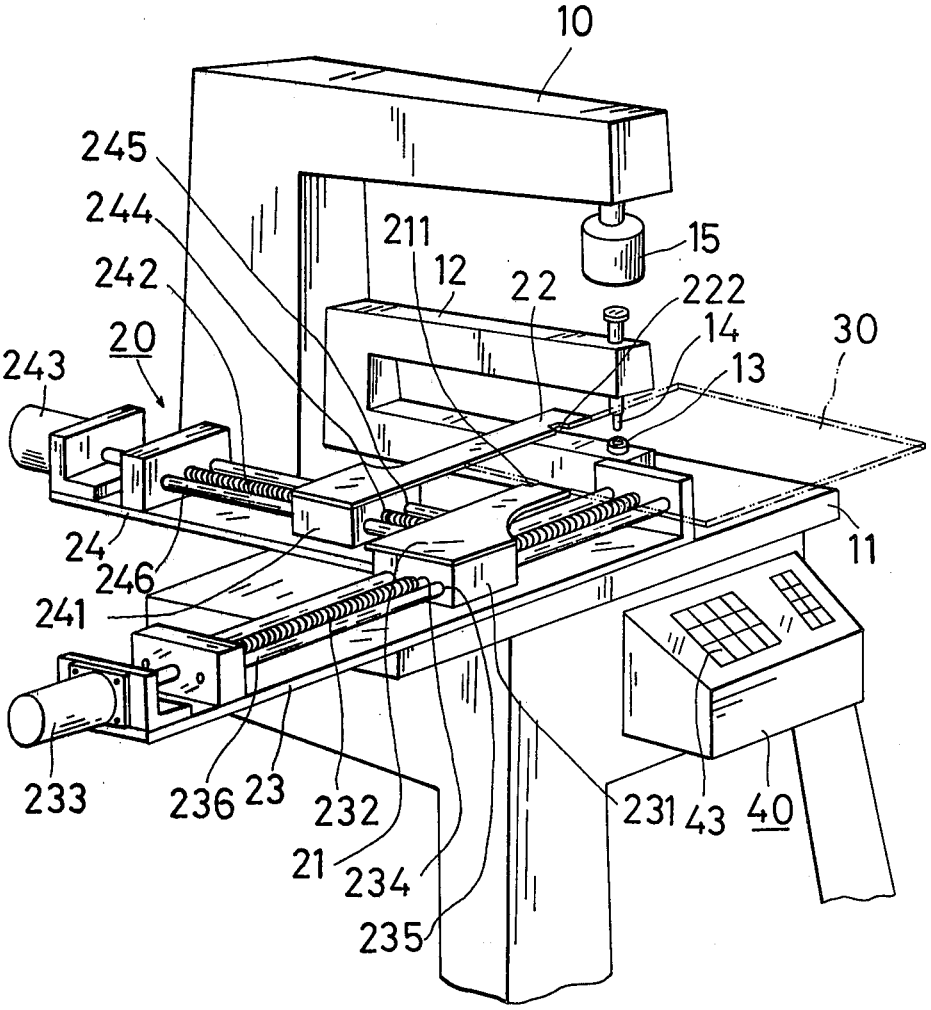
FIG. 1 is an isometric drawing of the positioning apparatus as it is used.
Figure 2:
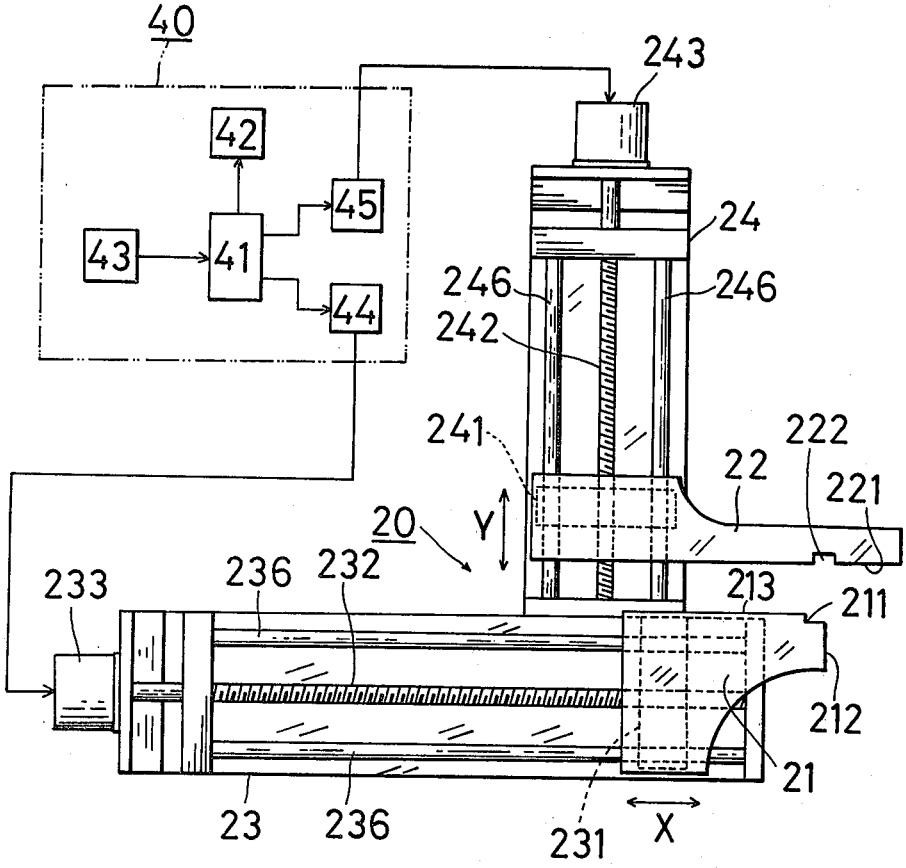
FIG. 2 is a top elevation of the present invention.
Figure 3:
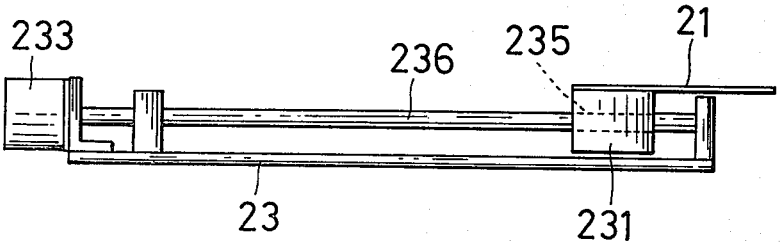
FIG. 3 is a front elevation of the present invention.

FIG. 1 is an illustration showing how the apparatus invention (20) is attached for use with a press machine (10). The press machine (10) is structured to have the main arm (12) and receiving anvil(die) (13) mounted on its main table (11) with a punch (14) mounted in the arm (12). The punch (14) impacts with the die (13) through the action of hammer (15) so as to punch a hole in the plate material (30).

The apparatus (20) consists of the number one workpiece stopper (21) moving along the X axis left and right relative to the punch machine in front of the punch and a number two workpiece stopper (22) moving along the Y axis perpendicular to the X axis, each of these workpiece stoppers (21 and 22) equipped with its own motor (23 and 24, respectively).

Number one workpiece stopper (21) moving along the X axis by means of number one motor (23) has as its forwardmost position the position of the punch (14) and is constructed with a cutout section (211) on its leading edge adequate to allowing the passage of the punch (14), the cutout section at right angles to and at the corner formed by the leading edge (212) and the inside edge (213). Number two workpiece stopper (22) moves along the Y axis by means of the number two motor (24) with its forwardmost position a position directly under the punch (14) and has its leading edge (221) extending to both sides of the punch (14) parallel to the X axis, with a cutout section (222) on its leading edge (221) directly under the path of the punch (14) adequate to allowing the passage of the punch (14).

In actual usage, the number one motor (23) and number two motor (24) are equipped each with a movable stand (231 and 241, respectively), a screw axle (232 and 242, respectively), and a reversible pulse motor (233 and 243, respectively), said pulse motors (233 and 243) imparting rotation to the screw axles (232 and 242) so as to move the movable stands (231 and 241) along their respective axes. Accordingly, said movable stands (231 and 241) are equipped with threaded holes (234 and 244) fitted to their screw axles (232 and 242) such that the direction and amount of rotation of the screw axles (232 and 242) determine the direction and distance of motion of each of the movable stands (231 and 241).

In its preferred embodiment, in order to smooth the movement of the movable stands (231 and 241), guide holes (235 and 245) have been bored in the base of each movable stand (231 and 241) and guide bars (236 and 246) run through these guide holes.

While number one and number two motors (23 and 24) may be otherwise, it is desirable that they be such as can be operated with pulse signals such as from a microcomputer, in that it is a purpose of this invention to automatically position plate materials for the punching of holes.

Number one workpiece stopper (21) is mounted and fixed atop movable stand (231) moved by the number one motor (23), and the base end of number two workpiece stopper (22) is mounted and fixed atop movable stand (241) moved by the number two motor (24).

Accordingly, the number two workpiece stopper is supported at one end by the movable stand (241) and extends out behind the punch (14).

Figure 4:
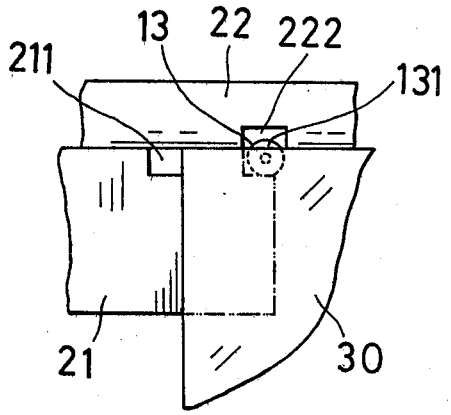
FIG. 4 is a top elevation of the major parts for explaining the operation of the positioning apparatus.

Control apparatus (40) is linked to said motors (23 and 24), and in its preferred embodiment control apparatus (40) uses microcomputer (41), display (42), keyboard (43), motion circuit (44) for the number one motor (23), and motion circuit (45) for the number two motor (24). In this embodiment, the positions in which one wishes to punch holes are entered in the computer by X axis and Y axis using the keyboard (43), and these values entered are displayed on the display (42), the microcomputer simultaneously sending signals to the motion circuits (44 and 45), which signals result in the emission of pulse signals from the motion circuits (44 and 45) to the pulse motors (23 and 24) so as to move the number one workpiece stopper (21) and the number two workpiece stopper (22) to the specified positions such that the position of the plate material is determined such that the desired locations on the plate material (30) come to be directly below the punch (14). As shown in FIG. 4, the edge of the plate (30) can be directly below the punch (14) when the number two workpiece stopper (22) is at its forwardmost position. In such a condition, even if the wall thickness of the outer edge (131) of the die (13) is thick, the die (13) can fit inside of the cutout section (212) in the leading edge of the number two workpiece stopper (22) so as to receive the punch (14), making it possible to punch holes in the edge of the plate material (30); and at the same time the number one workpiece stopper (21) can be moved forward so as to push the plate material (30), making it possible to punch a series of holes along the edge of the plate material (30).

When the number one workpiece stopper (21) is at its forwardmost position, its cutout section (211) joins with the cutout section (222) of the number two workpiece stopper (22) so as to form a space through which the punch (14) can pass, making it possible to punch holes even in the very corner edge of the plate material (30).

The number one workpiece stopper (21) and the number two workpiece stopper (22) should preferably be designed such that when the number two workpiece stopper (22) is at its forwardmost position its leading edge (221) meets the inside edge (213) of the number one workpiece stopper (21), the leading edge (212) of the number one workpiece stopper (21) and the leading edge (221) of the number two workpiece stopper (22) to form a right angle for most accurate positioning of the plate material (30).

What is claimed is:

1. A plate positioning apparatus for use with a punch machine having a punch, comprising:

a number one workpiece stopper movable back and forth along an X axis and having its leading edge perpendicular to the axis of motion and further having a cutout space on the inner corner of its leading edge, (b) a number one motor for moving said number one workpiece stopper back and forth along the X axis and controlling said number one workpiece stopper so that its leading edge at its forwardmost position is in front of the punch of the punch machine, (c) a number two workpiece stopper movable along a Y axis perpendicular to the X axis, having its leading edge perpendicular to the axis of motion, and having a cutout section in its leading edge adequate to allow the passage of the punch, (d) a number two motor for moving said number two workpiece stopper to and fro along the Y axis and controlling said number two workpiece stopper so that the cutout section in its leading edge at its forwardmost position is directly under the punch, and (e) a control apparatus for independently operating said number one and number two motors.

2. A plate positioning apparatus as in claim 1, wherein said control apparatus is a microcomputer and said number one and number two motors are operated with the output signals from said microcomputer.

3. A plate positioning apparatus as in claim 1, wherein said number one and number two motors include screw axles turned by separate reversible pulse motors, and movable stands threaded to said screw axles such that the forward or reverse rotation of said screw axles moves the movable stands back and forth along the axes, said the number one and number two workpiece stoppers being mounted on and affixed to said movable stands.

4. A plate positioning 1 apparatus as in claim 1, wherein the inner edge of said number one workpiece stopper on the punch side is straight and the leading edge of said number two workpiece stopper at its forwardmost position touches the inner edge of said number one workpiece stopper.

* * * * *